US010675495B2

(12) United States Patent
Tamura et al.

(10) Patent No.: US 10,675,495 B2
(45) Date of Patent: Jun. 9, 2020

(54) CT VALUE CONTROLLER AND ANTICANCER AGENT DEGRADATION APPARATUS

(71) Applicants: TAMURA TECO CO., LTD., Higashi-Osaka-shi, Osaka (JP); KINKI UNIVERSITY, Higashi-Osaka-shi, Osaka (JP)

(72) Inventors: Kozo Tamura, Higashi-Osaka (JP); Yoshiyuki Fukuda, Higashi-Osaka (JP); Shunji Ishiwata, Higashi-Osaka (JP); Atsushi Taga, Higashi-Osaka (JP)

(73) Assignees: TAMURA TECO CO., LTD., Higashi-Osaka-Shi (JP); KINKI UNIVERSITY, Higashi-Osaka-Shi (JP)

( * ) Notice: Subject to any disclaimer, the term of this patent is extended or adjusted under 35 U.S.C. 154(b) by 93 days.

(21) Appl. No.: 15/921,192

(22) Filed: Mar. 14, 2018

(65) Prior Publication Data

US 2018/0200554 A1 Jul. 19, 2018

Related U.S. Application Data

(62) Division of application No. 14/899,024, filed as application No. PCT/JP2014/066199 on Jun. 18, 2014, now Pat. No. 10,004,932.

(30) Foreign Application Priority Data

Jun. 25, 2013 (JP) ..... 2013-132776

(51) Int. Cl.
*A62D 3/38* (2007.01)
*A62D 101/22* (2007.01)
(Continued)

(52) U.S. Cl.
CPC ..... *A62D 3/38* (2013.01); *A62D 2101/22* (2013.01); *A62D 2101/26* (2013.01); *A62D 2101/28* (2013.01)

(58) Field of Classification Search
None
See application file for complete search history.

(56) References Cited

U.S. PATENT DOCUMENTS 5,568,895 A * 10/1996 Webb ..... A61L 11/00 241/16
2002/0122856 A1 9/2002 Garwood
(Continued)

FOREIGN PATENT DOCUMENTS

JP 2003-190975 A 7/2003
JP 2008-104488 A 5/2008
(Continued)

OTHER PUBLICATIONS

Castegnaro, M. et al. "Chemical degradation of wastes. . ". Int. Arch Occup. Environ Health. 70: 378-384 (1997). (Year: 1997).*
(Continued)

*Primary Examiner* — Sheng H Davis
(74) *Attorney, Agent, or Firm* — Birch, Stewart, Kolasch & Birch, LLP

(57) ABSTRACT

A CT value controller includes a storage means, an input means, and a computing means. The storage means stores a function expressing a relative humidity and a CT value regarding a degradation degree of an anticancer agent, an assumed relative humidity, and a CT setting. The input means inputs a measured relative humidity and a measured ozone concentration at a time of degradation treatment of the anticancer agent. The computing means calculates a corrected CT value increment based on a difference between the measured relative humidity and the assumed relative humidity at every input of the relative humidity and the ozone
(Continued)

concentration by using the function. The computing means determines a termination of the degradation treatment of the anticancer agent when an integrated CT value of the corrected CT value increments reaches the CT setting.

2 Claims, 12 Drawing Sheets

(51) Int. Cl.
*A62D 101/26* (2007.01)
*A62D 101/28* (2007.01)

(56) References Cited

U.S. PATENT DOCUMENTS

| | | | | |
|---|---|---|---|---|
| 2003/0165404 | A1* | 9/2003 | Omatsu | G01N 31/223 422/400 |
| 2007/0196232 | A1* | 8/2007 | Klaptchuk | A61L 11/00 422/28 |
| 2008/0061006 | A1 | 3/2008 | Kerfoot | |

FOREIGN PATENT DOCUMENTS

| | | | |
|---|---|---|---|
| JP | 2010-269032 | A | 12/2010 |
| JP | 2011-218094 | A | 11/2011 |
| JP | 2012-75711 | A | 4/2012 |
| JP | 2012-91114 | A | 5/2012 |
| JP | 2013-85822 | A | 5/2013 |

OTHER PUBLICATIONS

"Medical Professional's Occupational Exposure to Anticancer Agents" excerpted from Osaka Prefectural Institute of Public Health News (42th issue, dated Dec. 24, 2009).

"Occupational Exposure: Risk for Medical Professionals Handling Anticancer Agents" excerpted from Medical Journal of Kinki University published in 2011 (vol. 36, 1st issue, pp. 43 to 46).

Castegnaro, M. et al., "Chemical Degradation of Wastes of Antineoplastic Agents", Int. Arch. Occup. Environ. Health, vol. 70, pp. 378-384, 1997.

Chughtai, A. R., "The effect of Temperature and Humidity . . . ", Journal of Atmospheric Chemistry, vol. 45, pp. 231-243, 2003.

Hernandez, et al., "Ozonation of Cisplatin in Aqueous Solution at pH 9", Ozone: Science and Engineering, May-Jun. 2008, vol. 30, No. 3, p. 189•196.

Ishiwata, "Ozone Gas ni yoru Koganzai no Bunkai", The Pharmaceutical Society of Japan Dai 134 Nenkai, Mar. 29, 2014, 29N•am15.

Lester, et al., "Removal of pharmaceuticals using combination of UV/H202/03 advanced oxidation process", Water Science & Technology, 2011, vol. 64, No. 11, p. 2230•2238.

Tomioka et al., "Health Risks for Occupational Exposure to Anticancer (Antineoplastic) Drugs in Health Care Workers", Journal of Occupational Health, 2005, vol. 47, pp. 195-203.

Ueda et al., "Kankyo ni Hairyo shita Koganzai no Fukasseika Shori", The 25th APSTJ Annual Meeting Koen Yoshishu, Apr. 20, 2010, vol. 70, Supplement, p. 179.

* cited by examiner

CT VALUE CONTROLLER AND ANTICANCER AGENT DEGRADATION APPARATUS

CROSS REFERENCE TO RELATED APPLICATIONS

This application is a Divisional of copending application Ser. No. 14/899,024, filed on Dec. 16, 2015, which was filed as a National Phase of PCT International Application No. PCT/JP2014/066199 on Jun. 18, 2014, which claims the benefit under 35 U.S.C. § 119(a) to Patent Application No. 2013-132776, filed in Japan on Jun. 25, 2013, all of which are hereby expressly incorporated by reference into the present application.

TECHNICAL FIELD

The present invention relates to a technology for degradation of flyoff of an anticancer agent during drug preparation or other circumstance to protect, for example, medical professionals from anticancer agent exposure.

BACKGROUND ART

Anticancer agents have been widely used for various cancer treatments, including cancer removal surgery and radiotherapy. An anticancer agent is orally or intravenously given to a patient. It is well known that a patient who received administration of an anticancer agent suffers from side effects, such as loss of hair, nausea, myelosuppression, intraoral erosion, and skin problems. This is because anticancer agents not only act on cancer cells but also destroy normal cells.

An anticancer agent causes genetic disorders and impairs cell division even when taken by people in good health, and can thus be said as a potent carcinogen. As a problem which has come to the fore in recent years, medical professionals, including doctors and pharmacists who handle anticancer agents, are suffering from health damage resulting from exposure to spatters of an anticancer agent during drug preparation and administration (refer to Non Patent Literatures 1 to 3).

In this regard, in Patent Literature 1 for example, there is shown a technique to prevent leakage of an anticancer agent during replacement of a bottle needle in a chemical line for each chemical bag accommodating an anticancer agent in intravenous transfusion operation (refer to Patent Literature 1).

CITATION LIST

Patent Literature

Patent Literature 1: Japanese Unexamined Patent Publication JP-A 2013-85822

Non Patent Literature

Non Patent Literature 1: "OCCUPATIONAL EXPOSURE: RISK FOR MEDICAL PROFESSIONALS HANDLING ANTICANCER AGENTS" excerpted from MEDICAL JOURNAL OF KINKI UNIVERSITY published in 2011 (Vol. 36, 1st issue, pages 43 to 46)

Non Patent Literature 2: "HEALTH RISK FOR MEDICAL PROFESSIONALS HANDLING ANTICANCER AGENTS" excerpted from INDUSTRIAL HYGIENE MAGAZINE published in 2005 by ENVIRONMENTAL HEALTH DIVISION IN OSAKA PREFECTURAL INSTITUTE OF PUBLIC HEALTH (Vol. 47, pages 195-203, written by KIMIKO TOMIOKA, SHINJI KUMAGAI) (URL:http://joh.sanei.or.jp/pdf/J47/J47_5_01.pdf#search=‘%E6%8A%97%E3%81%8C %E3%82%93%E5%89%A4+%E5%8C %BB %E7%99%82%E5%BE%93%E4%BA %8B %E8%80%85’)

Non Patent Literature 3: "MEDICAL PROFESSIONAL'S OCCUPATIONAL EXPOSURE TO ANTICANCER AGENTS" excerpted from OSAKA PREFECTURAL INSTITUTE OF PUBLIC HEALTH NEWS (42th issue, dated Dec. 24, 2009) (URL: http://www.iph.pref.osaka.jp/news/vol.42/news42.pdf#search=‘%E6%8A %97%E3%81%8C %E3%82%93%E5%89%A4+%E5%8C %BB %E7%99%82%E5%BE%93%E4%BA %8B%E8%80%85’)

SUMMARY OF INVENTION

Technical Problem

The art disclosed in Patent Literature 1 is expected to be effective in preventing leakage of an anticancer agent to a certain extent during infusion preparation.

However, preparatory work, such as a process of mixing an anticancer agent in a chemical bag, and an agent dissolving process required when an anticancer agent in powdery form is provided from a pharmaceutical company, needs to be conducted in a safety cabinet, for example. As to protection of medical professionals from anticancer agent flyoff during such an operation prior to handling of a chemical bag, no positive approach has been proposed to date. That is, the art disclosed in Patent Literature 1 is not adapted for prevention of exposure to flyoff of an anticancer agent or other chemicals.

The present invention has been devised in view of the problem as mentioned supra, and accordingly an object of the present invention is to provide an anticancer agent degradation apparatus and a CT value controller for use with the anticancer agent degradation apparatus for protecting medical professionals from exposure to an anticancer agent externally scattered in, for example, a safety cabinet or prescription laboratory, during drug preparation or other circumstance.

Solution to Problem

A CT value controller pursuant to the present invention comprises a storage means, an input means, and a computing means.

The storage means is for storing a function using a relative humidity of an ozone-containing air and a CT value as variables and representing a relation between the variables and a degradation degree of an anticancer agent and for storing a CT setting as a degradation termination point of the anticancer agent when an assumed relative humidity is maintained during degradation treatment.

The input means is for inputting a measured relative humidity and a measured ozone concentration in a degradation environment at a time of degradation treatment of the anticancer agent from measurement apparatuses.

The computing means is for computing based on the function and the CT setting stored in the storage means, the measured relative humidity, and the measured ozone concentration.

In degradation treatment of the anticancer agent performed in a humidified environment, the computing means computes, every input of the relative humidity and the ozone concentration.

A CT value increment as a product of the ozone concentration multiplied by an input time interval of the ozone concentration, a first degradation degree calculated from the assumed relative humidity, the product, and a difference type of the function, a second degradation degree calculated from the relative humidity, the product, and a difference type of the function, and a corrected CT value increment as a product of the CT value increment multiplied by a value obtained by dividing the second degradation degree by the first degradation degree.

And, termination of the degradation treatment is determined when an integrated CT value of the corrected CT value increments at every input of the relative humidity and the ozone concentration reaches the CT setting.

An anticancer agent degradation apparatus pursuant to the present invention comprises a container for degradation treatment of the anticancer agent, an ozone generator configured to generate ozone gas, a humidifier configured to humidify an inside of the container, a measurement apparatus configured to measure an ozone concentration in the container, a measurement apparatus configured to measure a relative humidity in the container, and the CT value controller.

Advantageous Effects of Invention

The present invention provides the anticancer agent degradation apparatus and the CT value controller for use with the anticancer agent degradation apparatus for protecting medical professionals from exposure to the anticancer agent externally scattered in, for example, a safety cabinet or prescription laboratory, during drug preparation or other circumstance.

DESCRIPTION OF EMBODIMENTS

Figure 1:
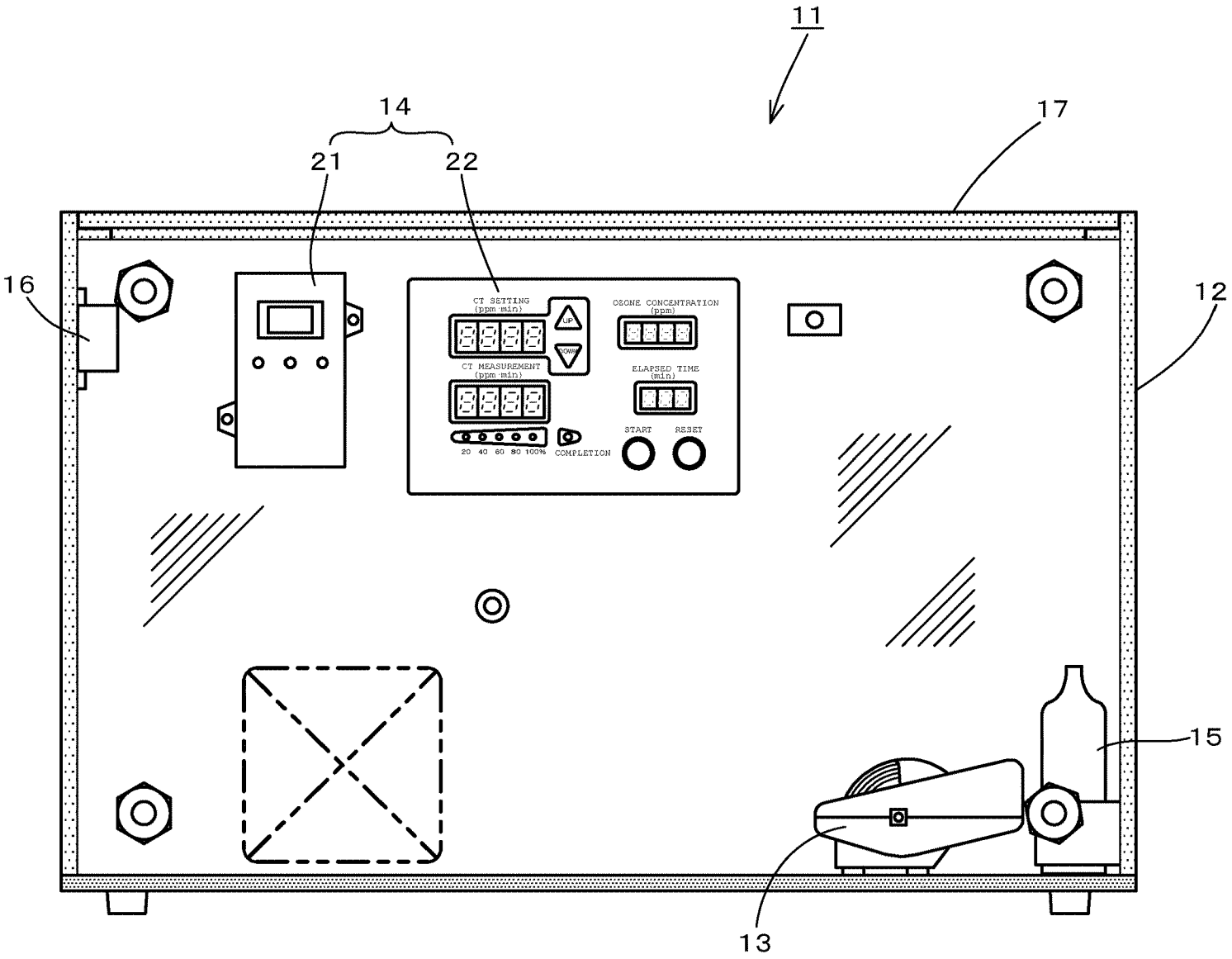
FIG. 1 is a front view of a tester used for anticancer agent degradation test.
Figure 2:
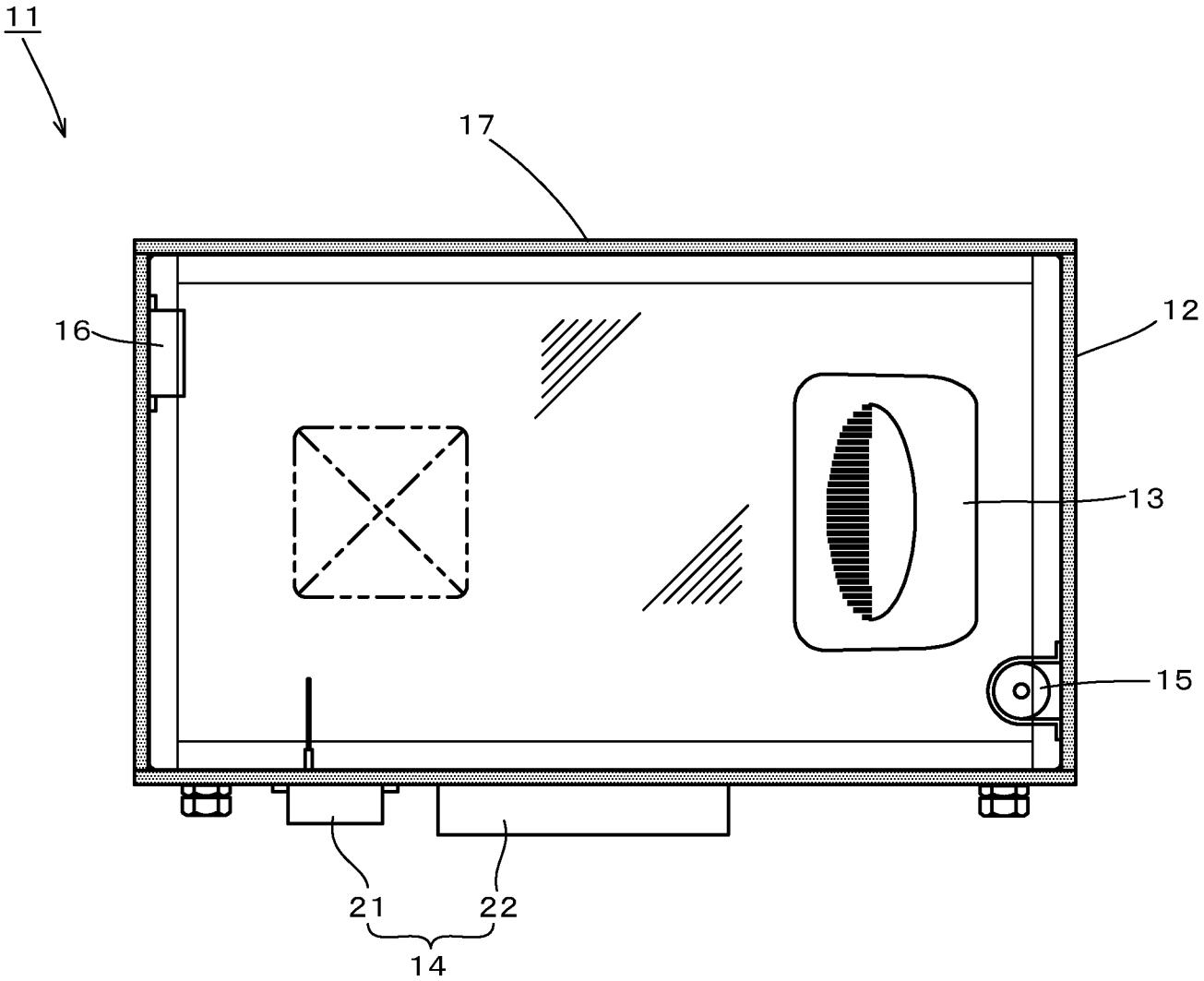
FIG. 2 is a plan view of the tester.
Figure 3:
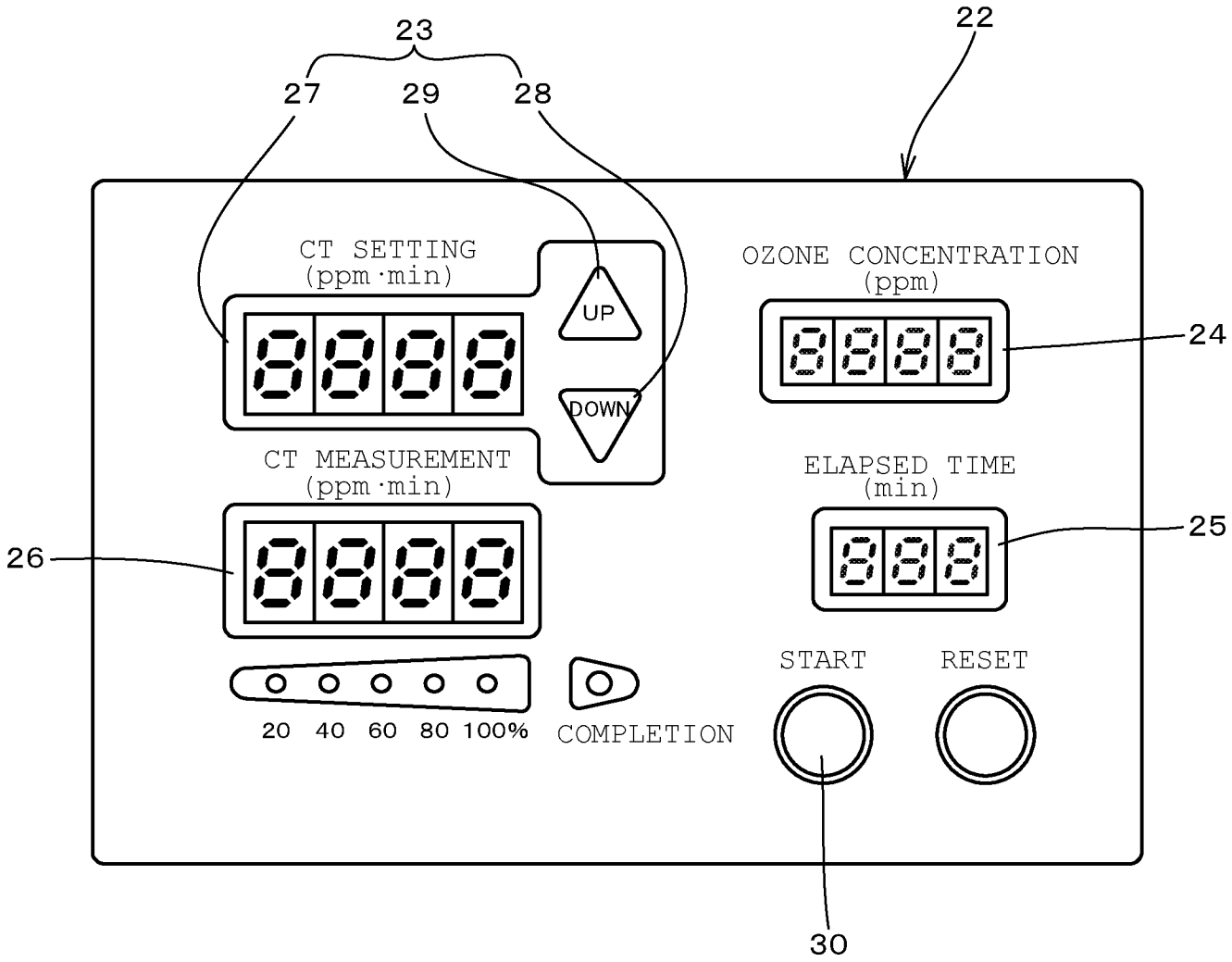
FIG. 3 is a front view of an operation display section 22.

FIG. 1 is a front view of a tester 11 used for anticancer agent degradation test, FIG. 2 is a plan view of the tester 11, and FIG. 3 is a front view of an operation display section 22.

The tester 11 comprises: a case 12; an ozone generator 13; a CT value controller 14; a humidifier 15; and a hygrometer 16.

The case 12 is a hollow box in the form of a rectangular prism, and its upper face is closed by a detachable lid 17.

The case 12 is made of a transparent vinyl chloride resin for external observation of the interior state.

The ozone generator 13 is a heretofore known stationary ozone gas generator incorporating an ozone lamp and a forced circulation fan.

The CT value controller 14 is composed of an ozone concentration sensor 21 and an operation display section 22. The ozone concentration sensor 21 detects the concentration of ozone within the case 12. The CT value controller 14 includes: storage means for storing data and so forth; input means for taking a humidity measured by the hygrometer 16, and ozone concentration measured by the ozone concentration sensor 21; computing means for performing computations on the basis of ozone concentration and so forth; and output means for sending data based on the result of computation out, and effecting activation and deactivation of connected devices.

The operation display section 22 is composed of a setting input portion 23, an ozone concentration display portion 24, an elapsed time display portion 25, and a CT measured value display portion 26, and so forth.

The setting input portion 23 includes a CT set value display 27, an UP button 28, and a DOWN button 29. The CT set value display 27 provides a CT set value which serves as a sterilization-test completion indicator. The UP button 28 and the DOWN button 29 are operated to change a CT set value shown on the CT set-value display 27.

The ozone concentration display portion 24 indicates ozone concentration detected by the ozone concentration sensor 21. The elapsed time display portion 25 indicates how much time has elapsed since the start of an anticancer agent degradation test in the presence of ozone. The CT measured value display portion 26 indicates a CT value corresponding to elapsed time shown on the elapsed time display portion 25. A CT value is equivalent to the product of ozone concentration in a micro time period and the duration of the micro time period.

In the tester 11, upon depression of a START button, the ozone generator 13 disposed in the casing 12 is activated, and simultaneously control is started on an anticancer agent degradation test on the basis of, for example, the ozone concentration detected by the ozone concentration sensor 21.

The humidifier 15 is a ceramic-made vessel with a heater attached to its bottom. Water (hot water) is put into the humidifier 15.

The following describes an anticancer agent degradation test that is conducted in the presence of ozone by the tester 11.

A prepared anticancer agent sample to be subjected to degradation was obtained by following a step of putting drops of 100 μL of a solution of an anticancer agent at a concentration of 1 μg/mL onto a small piece of aluminum foil, a step of standing it for two days at a temperature of 30 deg. C., and a drying step. In the following description, the aluminum foil bearing the dried anticancer agent will be referred to as "anticancer agent sample".

The anticancer agent used in the degradation test is Fluorouracil (product name: 5-FU manufactured and marketed by Kyowa Hakko Kirin Co., Ltd.)

In the anticancer agent degradation test in the presence of ozone, after the anticancer agent sample was set in the tester 11, the ozone generator 13 has been operated for a predetermined period of time. The degradation test went through the following steps: making a record of ozone concentration, humidity, and CT value in a condition of leaving the humidifier 15 running continuously to raise the humidity, or doing the same record-keeping after halting the operation of the humidifier 15; and measuring the amount of the anticancer agent which remains after the completion of degradation.

Figure 4:
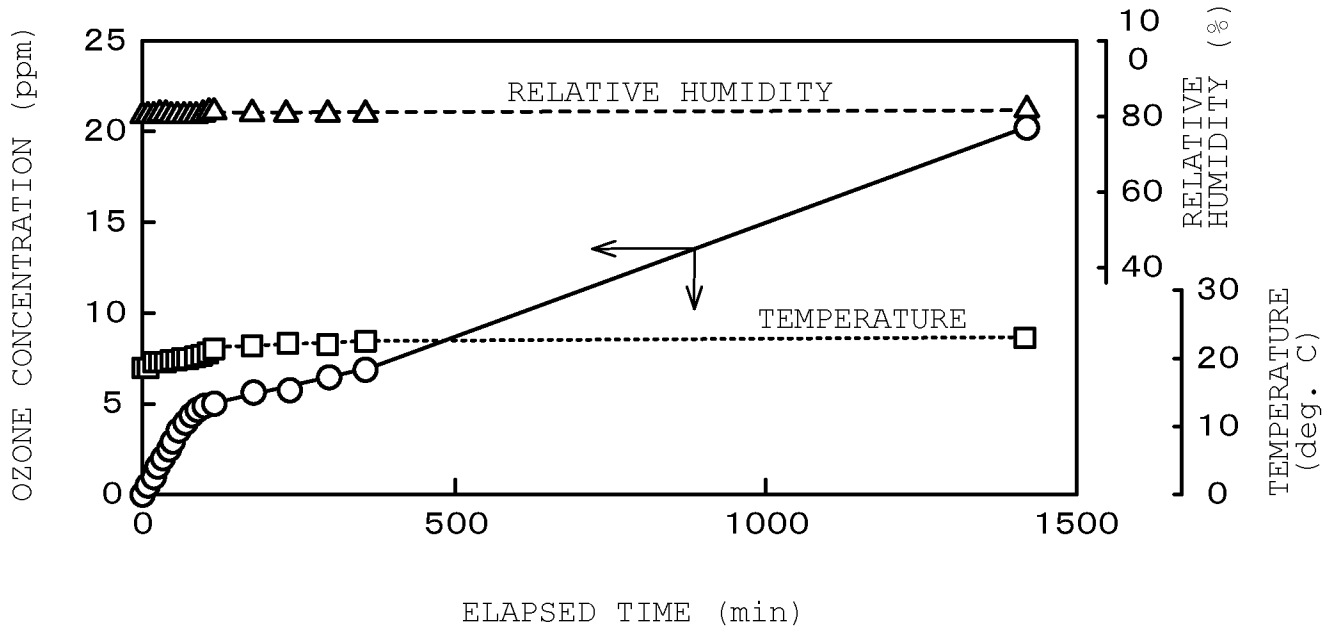
FIG. 4 is a chart showing ozone concentration, temperature, and humidity as observed in the course of anticancer agent degradation test.

FIG. 4 is a chart showing ozone concentration, temperature, and humidity in the case 12 in the course of the anticancer agent degradation test during operation of the humidifier 15.

After the completion of degradation in the presence of ozone, together with 1 mL of Milli-Q water (trademark) marketed by Merck Millipore Corporation, the anticancer agent sample has been agitated within a container to dissolve the remaining agent adherent to the aluminum foil in the Milli-Q water. The concentration of Fluorouracil in the resulting solution was determined by quantitative analysis using high performance liquid chromatography (HPLC). The solution thereby prepared for HPLC analysis will be referred to as "dissolved sample".

The degree of Fluorouracil degradation in the presence of ozone was evaluated by making a comparison with a blank serving as another dissolved sample obtained by dissolving an independently-prepared undegraded anticancer agent.

Conditions to be fulfilled in HPLC analysis are as follows:

Pump: Type L-2130 manufactured by GL Sciences Inc. (flow velocity: 1 mL/min);

Automatic sampler: Model 09 manufactured by System Instruments Co., Ltd. (injection amount: 100 μL);

Detector: SPD-6AV manufactured by Shimadzu Corporation (wavelength: 254 nm);

Column: CAPCELL PAK C18 (trademark) Type MG (Size: 4.6 mm ID×150 mm) manufactured by Shiseido Corporation;

A-D converter: Unit type: 15BXP-E2 manufactured by DACS Electronics (gain×1, 1000 ms); and Mobile phase: 50 mmol/L of phosphate buffer (pH 5.0) with methanol (ratio: 85:15).

Figure 5:
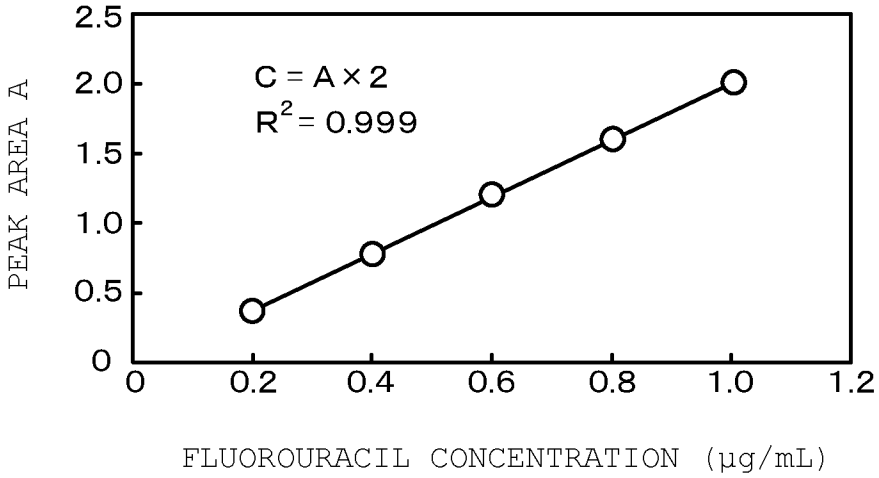
FIG. 5 is a chart showing a calibration curve of Fluorouracil.

FIG. 5 is a chart showing a calibration curve of Fluorouracil obtained in the aforestated analysis conditions. The calibration curve shown in FIG. 5 indicates that the HPLC quantitative analysis on Fluorouracil is highly reliable. On the basis of the calibration curve, the amount of Fluorouracil that remains after the completion of the degradation test, in other words, the amount of Fluorouracil degraded by the degradation test, can be determined.

In Table 1, there is shown the result of measurement of (undegraded) Fluorouracil concentration in each dissolved sample conducted after the completion of the degradation test. Five different values representing Fluorouracil concentration entered in the "Untreated" section of Table 1 are attributable to variations in preparation of dissolved samples of the anticancer agent.

TABLE 1

| | Fluorouracil concentration of dissolved sample (μg/mL) | | | |
|---|---|---|---|---|
| | Relative humidity: 80% | | | Relative humidity: 40% |
| No. | Untreated | Degradation test for 2 hours | Degradation test for 24 hours | Degradation test for 2 hours |
| 1 | 0.639 | 0.10 | 0.00 | 0.686 |
| 2 | 0.703 | 0.06 | 0.00 | 0.650 |
| 3 | 0.814 | 0.00 | 0.00 | 0.700 |
| 4 | 0.802 | — | — | 0.710 |
| 5 | 0.604 | — | — | 0.685 |
| average | 0.712 | 0.08 | 0.00 | 0.686 |
| Degradation rate R (—) | | 0.888 | 1.0 | 0.038 |

Figure 6:
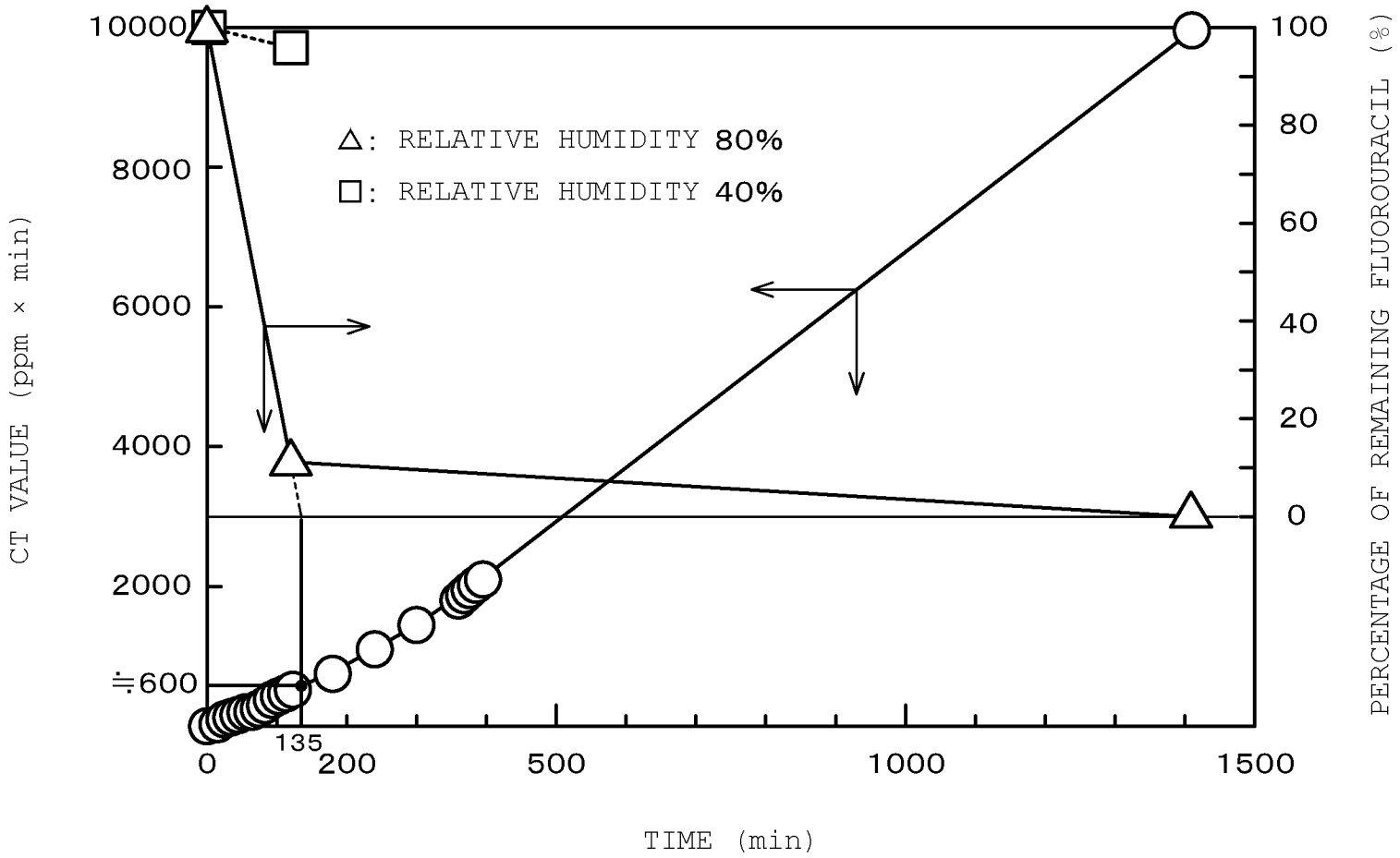
FIG. 6 is a chart showing CT values as observed in the course of anticancer agent degradation test in humidified conditions and the percentages of remaining anticancer agent.

FIG. 6 is a chart showing CT values as observed in the course of the anticancer agent degradation test in humidified conditions in relation to the data listed in Table 1, and the percentages of the remaining anticancer agent determined on the basis of the data listed in Table 1. At this time, ozone concentration, temperature, and humidity in the course of degradation of the anticancer agent (Fluorouracil) at a relative humidity (hereafter referred to simply as "humidity") of 80% conform to those plotted in FIG. 4. Changes in temperature and humidity in the course of degradation of the anticancer agent at a humidity of 40% differ little from those plotted in FIG. 4.

As shown in FIG. 6, the degradation of Fluorouracil in the presence of ozone gas proceeds in a shorter period of time in a high-humidity environment.

In Table 2, there is shown the result of examination of the degree of degradation of Fluorouracil thus far described at different humidities.

An anticancer agent sample for use in the Fluorouracil degradation test was obtained by putting drops of a solution which is the equivalent of 100 μL of 5-FU injection 250 Kyowa in undiluted form (250 mg/5 mL) manufactured and marketed by Kyowa Hakko Kirin Co., Ltd. (Fluorouracil 5 mg) onto a stainless plate measuring 10 cm×10 cm, and subsequently drying it on standing at room temperature. In the degradation test, after the stainless plate bearing Fluorouracil (anticancer agent sample) was set in the tester 11, the ozone generator 13 has been operated until the CT reading reached 80000 under humidity adjustment.

In reality, for purposes of convenience of amount control, instead of drops of an anticancer agent in undiluted form, drops of 1 mL of a solution obtained by diluting the anticancer agent at a 10-fold dilution factor were put onto the stainless plate. Also in the following description as to another anticancer agent, a numerical value representing the amount of the anticancer agent does not correspond to the actual amount of dropping but corresponds to an anticancer agent equivalent.

TABLE 2

| No. | Relative humidity (%) | Untreated (Blank) (μg) | Degraded (μg) | Degradation rate (—) |
|---|---|---|---|---|
| 6 | 70 | 385.4 | 334.6 | 0.131 |
| 7 | | | 372.4 | 0.337 |

TABLE 2-continued

| No. | Relative humidity (%) | Untreated (Blank) (μg) | Degraded (μg) | Degradation rate (—) |
|---|---|---|---|---|
| 8 | | | 384.6 | 0.021 |
| 9 | 80 | 517.7 | 0.0 | 1.00 |
| 10 | | | 114.5 | 0.779 |
| 11 | | | 87.4 | 0.831 |
| 12 | 90 | 502.9 | 0.0 | 1.00 |
| 13 | | | 0.0 | 1.00 |
| 14 | | | 0.0 | 1.00 |

In Table 3, there is shown the result of examination of the degree of degradation of another anticancer agent named Cytarabine at different humidities.

An anticancer agent sample was obtained by putting drops of 10 μL-equivalent Cylocide N (1 g) in undiluted form (1 g/50 mL) manufactured and marketed by NIPPON SHINYAKU Co., Ltd. (Cytarabine 0.2 mg) onto a stainless plate and subsequently drying it. In the degradation test, the anticancer agent sample set in the humidity-adjusted tester 11 has been exposed to ozone until the CT reading reached 80000 (ppm×min).

TABLE 3

| No. | Relative humidity (%) | Untreated (Blank) (μg) | Degraded (μg) | Degradation rate (—) |
|---|---|---|---|---|
| 15 | 70 | 267.5 | 186.2 | 0.304 |
| 16 | | | 122.5 | 0.542 |
| 17 | | | 58.4 | 0.782 |
| 18 | 90 | 195.7 | 0.0 | 1.00 |
| 19 | | | 0.0 | 1.00 |
| 20 | | | 0.0 | 1.00 |

Three anticancer agent samples were formed for each of tests conducted at different humidities. The amount of Fluorouracil that remains after the completion of degradation and the amount of undegraded Fluorouracil as listed in Table 2 have been determined in conformance with the way to obtain the measurement result as listed in Table 1.

Moreover, the amount of Cytarabine that remains after the completion of degradation and the amount of undegraded Cytarabine as listed in Table 3 have also been determined by HPLC analysis as adopted in the earlier described measurement on Fluorouracil. At this time, although the same detector, column, etc. were used, a mobile phase was as follows: 0.01 mol/L of monobasic potassium phosphate with acetonitrile (ratio: 95:5).

Figure 7:
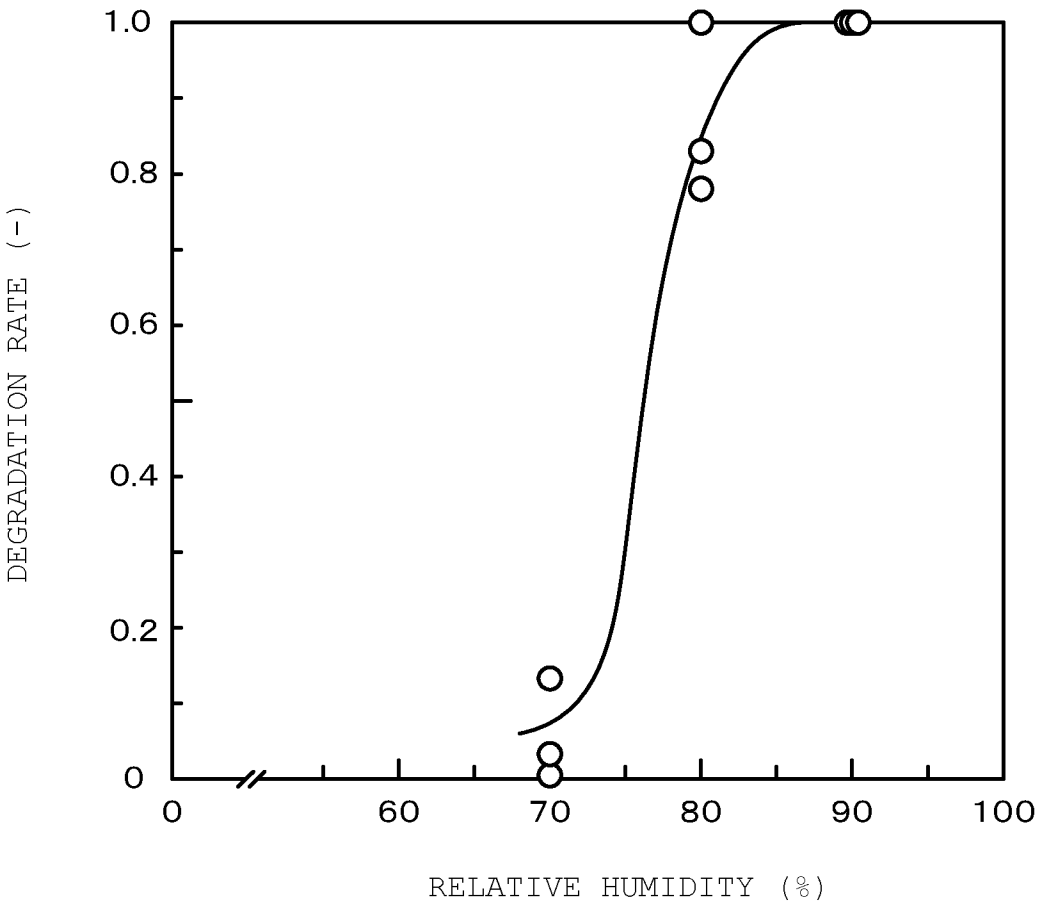
FIG. 7 is a chart showing a relationship between relative humidity and the rate of ozone-induced degradation of Fluorouracil at a CT value of 80000.
Figure 8:
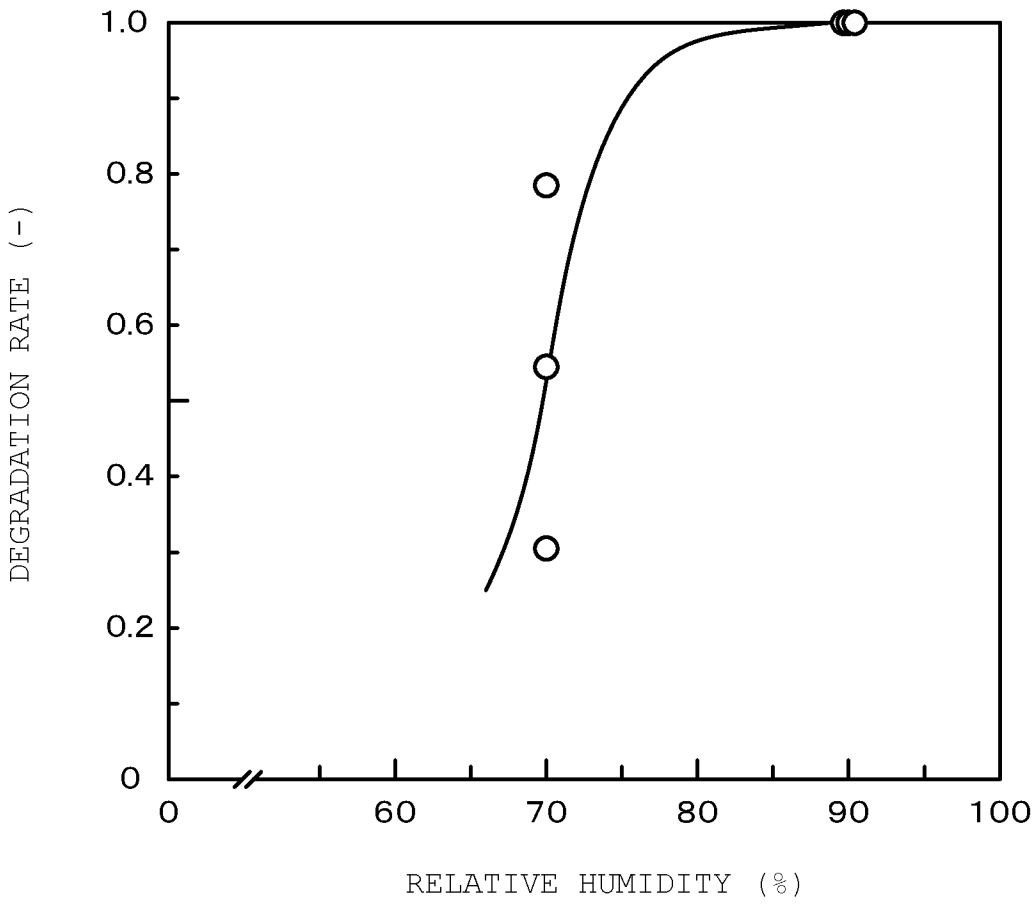
FIG. 8 is a chart showing a relationship between relative humidity and the rate of ozone-induced degradation of Cytarabine at a CT value of 80000.

FIGS. 7 and 8 are charts showing the relationship between each humidity and the rate of degradation of the anticancer agent derived from the data listed in Tables 2 and 3.

As will be seen in FIG. 7, there is an appreciable difference in degradation rate between Fluorouracil under a humidity of 70% and Fluorouracil under a humidity of 80%; that is, the rate of degradation increases at a humidity of at least 80% or above.

As shown in Table 1, the rate of degradation of Fluorouracil that has been subjected to degradation treatment for 24 hours at a humidity of 80% (at a CT value of 10000) is 100%. On the other hand, as shown in Table 2, some samples exhibited a degradation rate of only about 80% even after degradation treatment conducted in conditions of a humidity of 80% and a CT value of 80000. This is attributable to, for example, the dissimilarities between anticancer agent preparation methods, humidity distribution within the case 12, and positions of prepared samples.

It can be assumed from FIG. 8 that, as contrasted to Fluorouracil, Cytarabine is degraded at a high degradation rate (greatly degraded) at a humidity of 70%, and, just as is the case with Fluorouracil, the rate of degradation of Cytarabine becomes high at a humidity of at least 80% or above.

As will be seen in FIGS. 7 and 8, the degradation of each of Fluorouracil and Cytarabine proceeds in a shorter period of time in a high-humidity environment.

In Table 4, there is shown the result of degradation treatment using ozone gas that has been performed on each of other anticancer agents than those as above described at a humidity of 80% until the CT reading reached 60000.

TABLE 4

| Anticancer agent | No. | Untreated (Blank) (μg) | Degraded (μg) | Degradation rate (—) |
|---|---|---|---|---|
| Cyclophosphamide | 21 | 176.1 | 14.5 | 0.918 |
| | 22 | 176.1 | 5.5 | 0.969 |
| Ifosfamide | 23 | 318.5 | 201.0 | 0.367 |
| | 24 | 318.5 | 172.3 | 0.458 |
| Doxorubicin | 25 | 101.8 | 5.50 | 0.946 |
| | 26 | 101.8 | 19.6 | 0.807 |
| Etoposide | 27 | 155.6 | ND | 1.00 |
| | 28 | 155.6 | ND | 1.00 |

The following describes how a sample of each anticancer agent as listed in Table 4 (anticancer agent sample) is to be prepared.

[Cyclophosphamide]

A sample of Cyclophosphamide was obtained by following a step of dissolving 100 mg of "Endoxan for injection 500 mg" (trademark) manufactured and marketed by Shionogi & Co., Ltd. in undiluted form in 5 mL of purified water for preparation, a step of putting drops of the solution which is the equivalent of 10 μL of undiluted Endoxan (Cyclophosphamide 0.2 mg) onto a central area of a stainless plate measuring 10 cm×10 cm; and a step of drying it on standing at room temperature.

[Ifosfamide]

A sample of Ifosfamide was obtained by following a step of dissolving "Ifomide for injection 1 g" (trademark) manufactured and marketed by Shionogi & Co., Ltd. in undiluted form in 25 mL of purified water for preparation, a step of putting drops of the solution which is the equivalent of 10 μL of undiluted Ifomide (Ifosfamide 0.4 mg) onto a central area of a stainless plate measuring 10 cm×10 cm; and a step of drying it on standing at room temperature.

[Doxorubicin]

A sample of Doxorubicin was obtained by following a step of dissolving "Adriacin for injection 10" (trademark) manufactured and marketed by Kyowa Hakko Kirin Co., Ltd. in undiluted form in 1 mL of purified water for preparation, a step of putting drops of the solution which is the equivalent of 10 μL of undiluted Adriacin (Doxorubicin 0.1 mg) onto a central area of a stainless plate measuring 10 cm×10 cm; and a step of drying it on standing at room temperature.

[Etoposide]

A sample of Etoposide was obtained by following a step of preparing "Lastet for injection 100 mg/5 mL" (trademark) manufactured and marketed by Nippon Kayaku Co., Ltd. in undiluted form; a step of putting drops of the solution which is the equivalent of 10 μL of undiluted Lastet (Etoposide 0.2 mg) onto a central area of a stainless plate measuring 10 cm×10 cm; and a step of drying it on standing at room temperature.

The undegraded and degraded anticancer agents adherent to the stainless plates were each dissolved in Milli-Q water for recovery, and, quantitative analysis on the samples was entrusted to Shionogi Analysis Center Co., Ltd. Measurement on each of Cyclophosphamide, Ifosfamide, and Doxorubicin was conducted in accordance with HPLC, and measurement on was conducted in accordance with LC/MS/MS (Liquid chromatography mass spectrometry).

As will be seen in Table 4, although the degrees of degradation at a CT value of 60000 vary among Cyclophosphamide, Ifosfamide, Doxorubicin, and Etoposide, degradation of each anticancer agent proceeds in the presence of ozone gas in a 80%-humidity atmosphere.

The following describes an efficient anticancer agent degradation method based on the fact that degradation of an anticancer agent in the presence of ozone is promoted in an intentional high-humidity environment (for example, refer to "SEWAGE TREATMENT AND WASTE WATER TREATMENT BY OZONE UTILIZATION" excerpted from FUJI ELECTRIC JOURNAL Vol. 77 No. 3 (2004) URL: http://www.fujielectric.co.jp/about/company/jihou_2004/pdf/77_03/14.pdf#search='%E3%82%AA%E3%82%BE %E3%83%B3+%E7%B5%8C%E6%99%82CT'). For example, in sterilization treatment utilizing ozone, in general, CT values are monitored, and, the process is brought to an end upon the CT reading reaching a predetermined value. Also in an anticancer agent degradation method as will hereafter be described, a CT value at which degradation treatment is brought to an end (CT setting) is determined in advance depending on the type of an anticancer agent. The CT value increases as degradation treatment proceeds, and, upon the CT reading reaching the CT setting, degradation treatment is brought to an end.

It will be apparent from FIG. 6 that degradation of an anticancer agent is promoted at an increased-humidity degradation environment. Thus, a low CT setting can be adopted in degradation treatment at a high humidity. The CT setting, which is a value indicative of the termination of anticancer agent degradation treatment in the presence of ozone, is determined in accordance with a humidity for the treatment.

In most cases, a facility that necessitates ozone treatment for degradation of anticancer agent flyoff, such as a safety cabinet or prescription laboratory, is not provided with a humidity control function. Therefore, changes in humidity cannot be avoided only by operating the humidifier, for example. That is, in an environment where humidity setpoint control cannot be exercised properly, degradation treatment proceeds over a period of time at a humidity different from a humidity H corresponding to the CT setting. During this time period, if a low-humidity condition continues, the degradation treatment may be brought to an end even though an anticancer agent has not been degraded sufficiently. Furthermore, if a humidity in degradation treatment is higher than the humidity H corresponding to the CT setting, unduly much time will be spent on the degradation treatment, thus causing inefficient operation of a degradation apparatus and poor economy.

To eliminate such problems, namely variations in the degree of anticancer agent degradation resulting from humidity fluctuations and inefficient apparatus operation, humidity monitoring is conducted in the course of ozone degradation treatment, and the termination of anticancer agent degradation treatment is determined with consideration given to humidity measurement.

Figure 9:
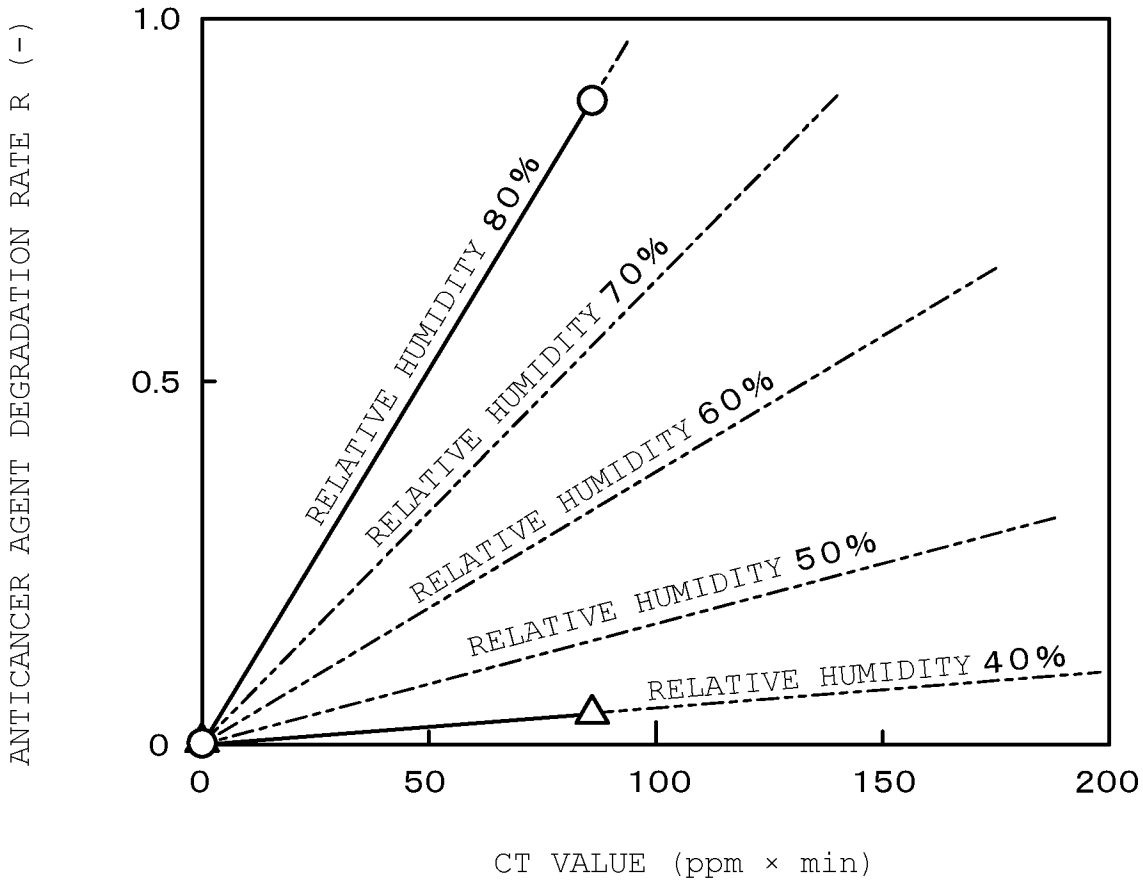
FIG. 9 is a chart showing a proportional relationship between CT value and the rate of anticancer agent degradation.
Figure 10:
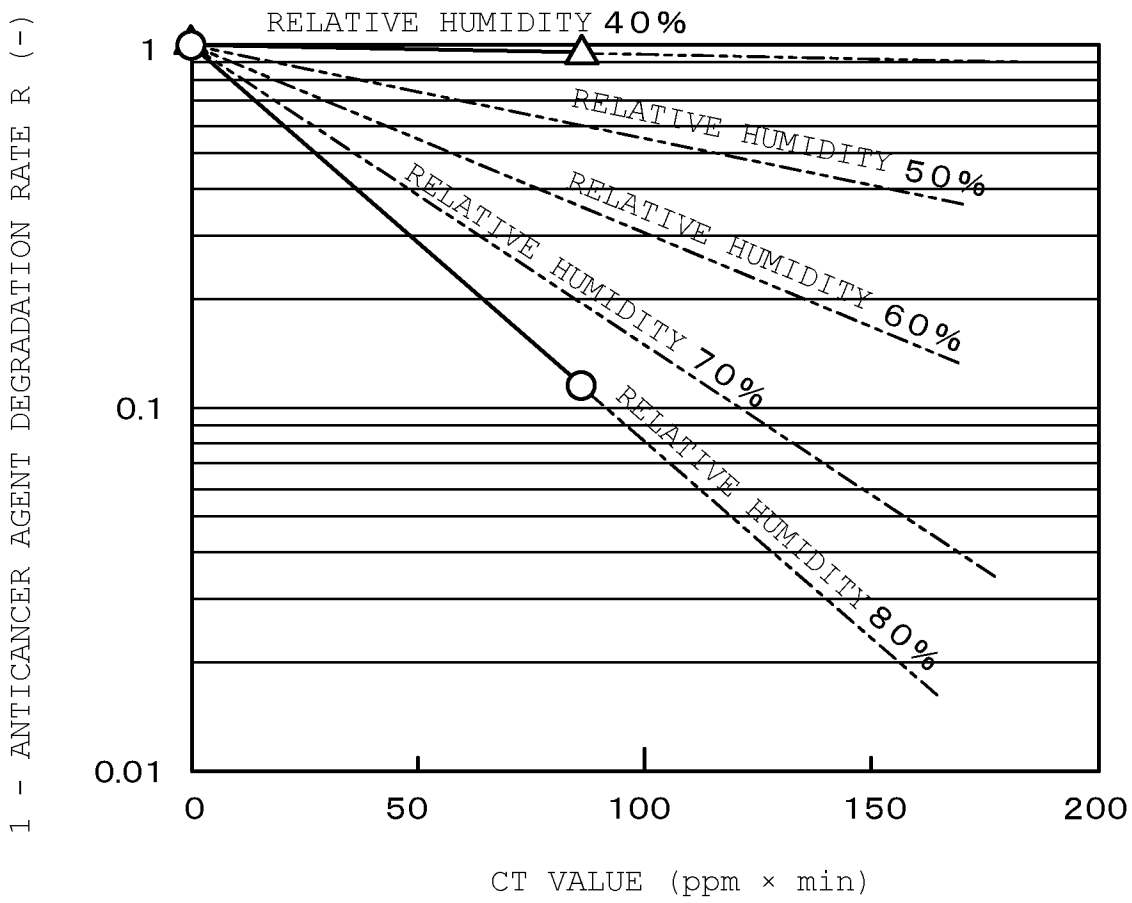
FIG. 10 is a chart showing a case where an increment of the rate of anticancer agent degradation is reduced as the CT value increases.

FIGS. 9 and 10 are charts showing the influence of humidity on the relationship between degradation of an anticancer agent and the CT value (hereafter also referred to simply as "CT").

FIG. 9 is a chart plotted on the assumption that the CT value and an anticancer agent degradation rate R are proportional (ΔR divided by ΔCT equals a constant). FIG. 10 is a chart plotted on the assumption that an increment of the anticancer agent degradation rate R is reduced as the CT value increases (ΔR÷CT). The anticancer agent degradation rate R is expressed in equation form as: R equals [concentration of undegraded anticancer agent (blank) minus concentration of anticancer agent remaining after degradation] divided by the undegraded anticancer agent concentration (in dissolved samples).

As shown in Table 1, the concentration of undegraded Fluorouracil remaining after a lapse of 2 hours in degradation treatment was reduced more greatly at a humidity of 80% than at a humidity of 40%. At least in a range in which the humidity exceeds 40% but less than 80%, there is every reason to assume that, the higher is the humidity, the faster is the progression of degradation of Fluorouracil (anticancer agent).

According to Table 1, the CT value-Fluorouracil degradation rate R (hereafter also referred to simply as "degradation rate R") relationship at humidities ranging from 40% or above to 80% or below is plotted in FIG. 9 or FIG. 10 wherein humidities serve as parameters. The chain double-dashed lines in FIGS. 9 and 10 were drawn on the basis of estimations from the data shown in FIG. 6.

Anticancer agent degradation rates R, which vary with an increase of the CT value, in environments of different humidities are determined in advance by using the tester 11, for example.

In FIG. 9, the relationship between CT corresponding to each humidity and the degradation rate R can be represented by Linear expression (1) wherein a coefficient K can be approximated to Formula (2) wherein H (humidity) is an independent variable.

$$R=K\times CT \tag{1}$$

$$K=f(H) \tag{2}$$

f(H) can be obtained by calculation using the method of least squares after examining the correlation between each humidity and a coefficient K corresponding to the humidity plotted in plotting paper, semi-logarithmic graph paper, or double-logarithmic graph paper. The specific form of f(H) varies depending on the type of an anticancer agent.

On the basis of Linear expression (1) and Formula (2), the degradation rate R can be expressed by Formula (3) wherein H (humidity) is a variable.

$$R=f(H)\times CT \tag{3}$$

Figure 11:
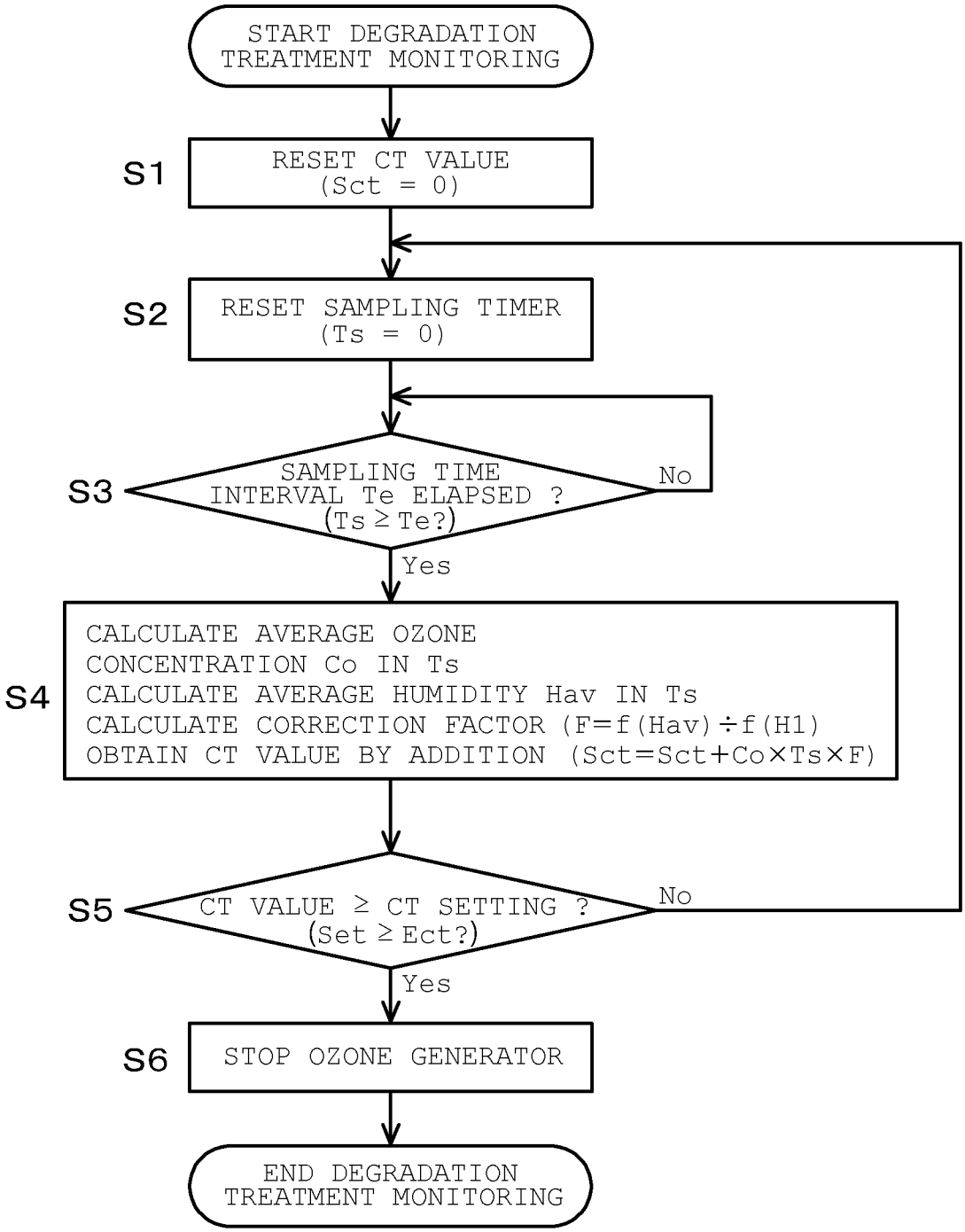
FIG. 11 is a flow chart for reflecting measured humidity in degradation treatment termination.
Figure 12:
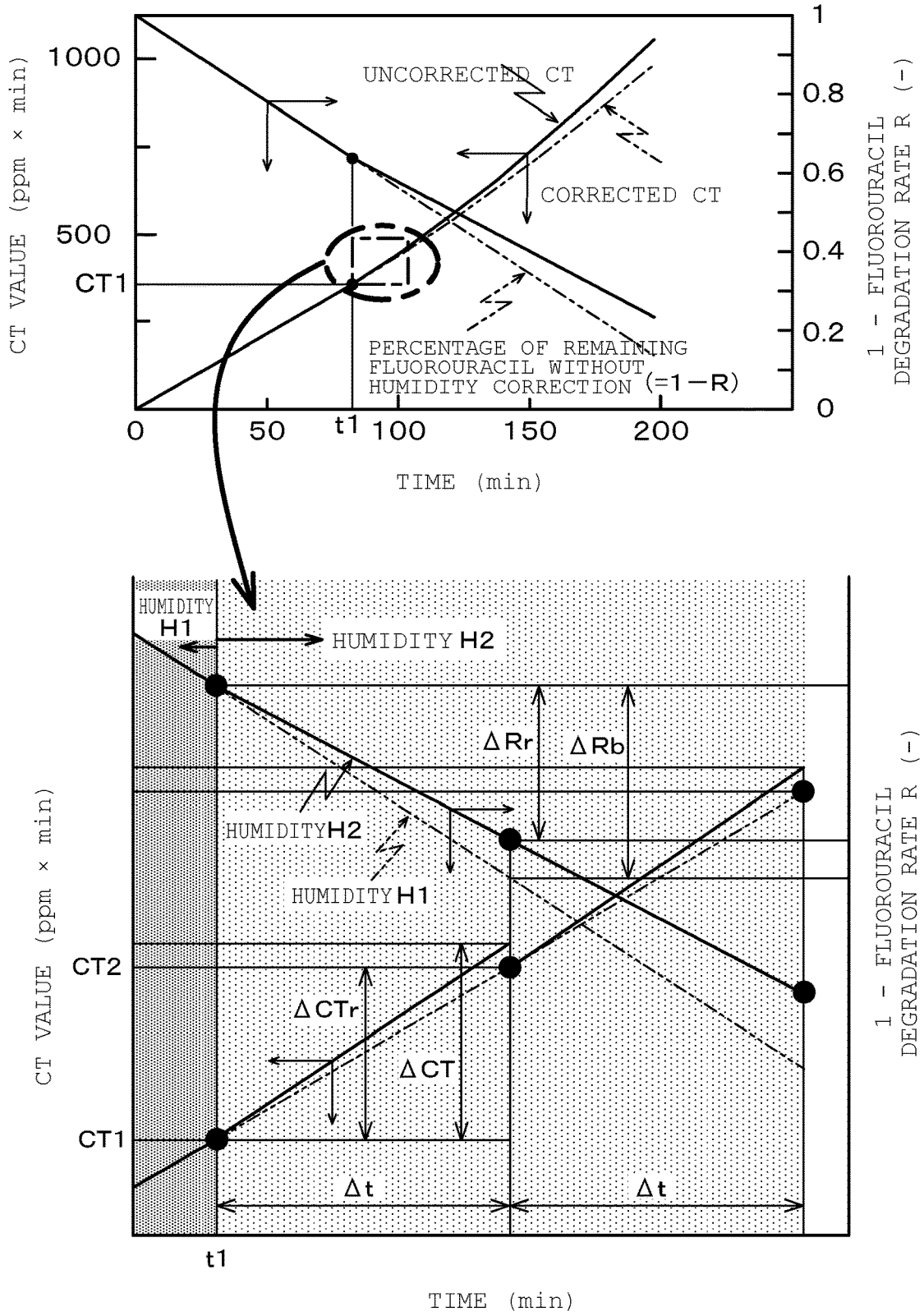
FIG. 12 is a conceptual illustration of the procedural steps shown in FIG. 11.

FIG. 11 is a flow chart showing procedural steps to be performed in reflecting a measured humidity in the judgment as to the termination of anticancer agent degradation treatment, and FIG. 12 is a conceptual illustration of the procedural steps shown in FIG. 11.

The following process is executed by the CT value controller 14, for example.

It is assumed that most part of anticancer agent degradation treatment in the presence of ozone gas is effected at a humidity of H1%, and a CT setting corresponding to the humidity of H1% is inputted to the CT value controller 14.

Insofar as a humidity in a space where the anticancer agent degradation treatment is effected constantly stands at H1%, then the degradation treatment is brought to an end upon the measured CT reading reaching the CT setting.

Considering that the humidity declined from H1% to H2% (H1>H2) after time t1 has elapsed since the start of the degradation treatment, then the CT value as found after a lapse of the time t1 is CT1. Assuming that micro time Δt (Ts) has elapsed after the t1 lapse ("YES" in Step S3 shown in the flow chart), then an increment ΔCT of the CT value in this time period is derived from the measured average ozone concentration Co as: ΔCT=Co×Δt (Step S4).

In FIG. 11, Te (sampling time interval) represents a setting of sampling time interval stored in advance in the CT value controller 14, and Ts represents an actual sampling time interval obtained immediately after the sampling time interval setting Te has elapsed since a reset of a sampling timer (Step S1) following the previous sampling ("YES" in Step S3).

On the basis of Formula (3), given the humidity of H1%, then an anticancer agent degradation rate ΔRb during the time the CT value is increased at the increment ΔCT is expressed in equation form as:

$$\Delta Rb=f(H1)\times\Delta CT \quad (4).$$

However, since the measured humidity is H2%, it follows that an anticancer agent degradation rate ΔRr predicted during this time period is expressed in equation form as:

$$\Delta Rr=f(H2)\times\Delta CT \quad (5)$$

On the basis of Formulae (4) and (5), the following relationship holds:

$$\Delta Rr\div\Delta Rb=f(H2)f(H1) \quad (6)$$

wherein the quotient given as: f(H2)÷f(H1) defines a correction factor F shown in FIG. 11 (Step S4).

A modification of Formula (6) is the following formula:

$$\Delta Rr=\{f(H2)\div f(H1)\}\times\Delta Rb \quad (7).$$

Let it be assumed that anticancer agent degradation treatment has been conducted at a humidity of H1%, then an increment ΔCTr of the CT value to increase the degradation rate by an amount of ΔRr is derived on the basis of the following formulae:

$$\Delta Rr=f(H1)\times\Delta CTr \quad (8); \text{ and}$$

$$\Delta CTr=\Delta Rr\div f(H1) \quad (9).$$

Given that the CT value controller 14 is configured at a mode of determining the termination of anticancer agent degradation at a CT setting corresponding to a humidity of H1%, then, on the basis of Formulae (4) and (9), the increment ΔCTr of the CT value appropriate to the actual degree of degradation of an anticancer agent under degradation treatment at a humidity of H2% (ΔRr) is expressed in equation foLm as:

$$\Delta CTr=\Delta CT\times\{f(H2)\div f(H1)\} \quad (10).$$

That is, the CT value controller 14 is designed so that, after ΔCTr is added to the CT value in storage (CT1) instead of ΔCT, whether or not to bring degradation treatment to an end is determined by making a comparison between a CT value obtained by the addition and the CT setting (Step 5).

When the CT value obtained by the addition (CT2, or Sct in FIG. 11) is greater than the CT setting (Ect) ("YES" in Step S5), then the CT value controller 14 operates to deactivate the ozone generator 13, for example.

Rather than ΔCT which is the product of the measured ozone concentration and the actual elapsed period of time, ΔCTr, which is a corrected value based on the measured humidity, is added to the CT value. This makes it possible to determine the termination of anticancer agent degradation treatment that reflects the actual degree of anticancer agent degradation.

The anticancer agent degradation method thus far described succeeds in solving the problem of causing termination of degradation treatment despite insufficient degradation of an anticancer agent and the problem of spending unduly much time on degradation treatment entailed by an anticancer agent degradation environment where humidification is effected by a humidifier devoid of a humidity set-point control function.

The following describes correction of the increment ΔCT of the CT value from the measured humidity for a case where a linear relationship is employed between the CT value and the natural logarithm of the percentage of a remaining anticancer agent (1−anticancer agent degradation rate R) as shown in FIG. 10.

In FIG. 10, given that there is a linear relationship between the CT value and the percentage of the remaining anticancer agent, then Formula (11) holds:

$$In(1-R)=-f(H)\times CT \quad (11),$$

and a modification of Formula (11) is as follows:

$$R=1-\mathrm{Exp}\{-f(H)\times CT\} \quad (12)$$

wherein f(H), while representing a constant on a humidity-by-humidity basis, represents a function which holds at humidities falling within a predetermined range, wherein H (humidity) is an independent variable.

On the basis of Formula (12), an increment ΔR of the anticancer agent degradation rate R related to a micro increment ΔCT of the CT value is expressed in equation form as:

$$\Delta R=f(H1)\times\mathrm{Exp}\{-f(H)\times CT\}\times\Delta CT \quad (13).$$

As is the case with FIG. 9, it is assumed that the humidity declined from H1% to H2% after time t1 has elapsed since the start of the degradation treatment. Also in this case, the CT value as found after a lapse of the time t1 is CT1. Given that an increment of the CT value as found after a lapse of micro time is ΔCT; an increment of the anticancer agent degradation rate R corresponding to a humidity of H1% predicted from FIG. 10 is ΔRb; and an increment of the anticancer agent degradation rate R corresponding to a humidity of H2% is ΔRr, then the following formulae hold:

$$\Delta Rb=f(H1)\times\mathrm{Exp}\{-f(H1)\times CT1\}\times\Delta CT \quad (14);$$

and $$\Delta Rr=f(H2)\times\mathrm{Exp}\{-f(H2)\times CT1\}\times\Delta CT \quad (15).$$

Micro time has elapsed after a decline of the humidity to H2%, wherefore, in reality, an increment of the anticancer agent degradation rate R is given by ΔRr. In an environment with a humidity of H1%, an increment ΔCTr of the CT value to obtain an increment ΔRr is defined by the following formula:

$$\Delta Rr=f(H1)\times\mathrm{Exp}\{-f(H1)\times CT1\}\times\Delta CTr \quad (16)$$

wherein ΔRr is substituted for ΔRb in Formula (14), and ΔCTr is substituted for ΔCT therein.

On the basis of Formulae (15) and (16), the following formula is derived:

$$\Delta Ctr=\{f(H2)\div f(H1)\}\times G\times\Delta CT \quad (17)$$

from which the following formula is derived:

$$G=\mathrm{Exp}\{-f(H2)\times CT1\}\div\mathrm{Exp}\{-f(H1)\times CT1\} \quad (18).$$

When the termination of anticancer agent degradation is determined on the basis of a CT setting specified assuming a humidity of H1%, for the time period over which degradation treatment is performed at a humidity of H2%, as a practical matter, rather than actually measured ΔCT, a corrected value obtained by multiplying ΔCT by a value given by: {f(H2)÷f(H1)}×G is adopted for use as an increment of the CT value conducive to anticancer agent degradation. By making a correction to ΔCT to obtain a corrected value ΔCTr which is added to the immediately preceding CT value, even with changes in humidity in an anticancer agent degradation environment, the desired termination of anticancer agent degradation treatment can be determined with higher accuracy.

Given that, in contract to the cases with FIGS. 9 and 10, there is the highest degree of correlation between the CT value and the percentage of a remaining anticancer agent (1−anticancer agent degradation rate R), with humidities serving as parameters, on double-logarithmic graph paper, then the relationship between the CT value and the percentage is expressed in equation form as:

$$1-R=CT^{-f(H)} \quad (20)$$

wherein f(H) represents a value obtained by measuring the gradient of the percentage of a remaining anticancer agent (1−anticancer agent degradation rate R) to the CT value corresponding to each humidity plotted on the double-logarithmic graph paper as a function of humidity.

On the basis of Formula (20), an increment ΔR of the degradation rate R related to a micro increment ΔCT of the CT value is expressed in equation form as:

$$\Delta R=f(H)\times CT^{-f(H)-1}\times\Delta CT \quad (21).$$

As is the case with FIGS. 9 and 10, in exercising termination control on the basis of the CT setting corresponding to an expected humidity of H1%, if ΔCT is adopted for the time period over which degradation treatment is performed at a measured humidity of H2%, the intended anticancer agent degradation rate cannot be obtained even after the CT reading reaches the CT setting (H2<H1), or unduly much time will be spent on the degradation treatment (H2>H1). It is thus desirable to adopt, rather than actually measured ΔCT, a corrected value ΔCTr defined by the following formulae (22) and (23):

$$\Delta CTr=G\times\Delta CT \quad (22); \text{ and}$$

$$G=\{f(H2)\div f(H1)\}\times CT^{f(H1)-f(H2)} \quad (23)$$

as a CT increment to be added to the CT value for the time period over which degradation treatment is performed at a measured humidity other than the humidity H1%.

Also in anticancer agent degradation treatment involving the highest degree of correlation between the CT value and the percentage of a remaining anticancer agent (1−anticancer agent degradation rate R) plotted on double-logarithmic graph paper, even with a change of the humidity of an anticancer agent degradation environment from the intended value, by making a correction to ΔCT to obtain a corrected value to be added in accordance with the intended humidity H1% and the measured humidity H2, it is possible to achieve efficient anticancer agent degradation treatment without fail.

In the embodiments as described heretofore, other anticancer agents, including Gemcitabine hydrochloride (Gemzar™), Paclitaxel (Taxol™), and Docetaxel hydrate (Taxotere™), can be subjected to degradation treatment.

Moreover, an anticancer agent degradation apparatus for use in degradation of an anticancer agent in a humidified environment, and the constituent components, the general structure, the form, the dimensions, the materials of the anticancer agent degradation apparatus, and also the number of the apparatuses may be changed without departing from the spirit or scope of the invention.

INDUSTRIAL APPLICABILITY

The invention is adaptable for use in degradation of flyoff of an anticancer agent during drug preparation or other circumstance to protect, for example, medical professionals from anticancer agent exposure.

EXPLANATION OF REFERENCE SYMBOLS

14 Computing means (CT value controller)
15 Humidifying means (Humidifier)
Co Ozone concentration
Ect CT setting
H, H1, and H2 Relative Humidity

The invention claimed is:

1. A CT value controller comprising:

storing a function relating a relative humidity and a CT value to a degradation degree of an anticancer agent in degradation of the anticancer agent, the degradation being caused by ozone gas-containing air, and storing a CT setting (Ect) as a degradation termination point of said anticancer agent when a set relative humidity (H1) is maintained during degradation treatment, wherein the CT value is a product of ozone concentration and a time interval;

the CT value controller being programmed so as to, at set sampling time intervals (Δt, Te), take a relative humidity (H2) measured by a hygrometer and an ozone concentration (Co) measured by an ozone concentration sensor, obtain:

a CT value increment (ΔCT) calculated as a product of said set sampling interval (Δt, Te) and said ozone concentration (Co), a first degradation degree (ΔRb) calculated from said set relative humidity (H1), said CT value increment (ΔCT), and a difference in said function, a second degradation degree (ΔRr) calculated from said relative humidity (H2), said CT value increment (ΔCT), and the difference in said function, a value (F, G) obtained by dividing said second degradation degree (ΔRr) by said first degradation degree (ΔRb), and a corrected CT value increment (ΔCTr) calculated as a product of said CT value increment (ΔCT) and said value (F,G), and determine termination of said degradation treatment when a CT value (CT2, Sct), obtained by adding said corrected CT value increment (ΔCTr), reaches said CT setting (Ect).

2. An anticancer agent degradation apparatus comprising:

a container for degradation treatment of said anticancer agent;

an ozone generator configured to generate ozone gas;

a humidifier configured to humidify an inside of said container;

a measurement apparatus configured to measure an ozone concentration in said container;

a measurement apparatus configured to measure a relative humidity in said container; and the CT value controller according to claim 1.

* * * * *